US010665219B2

(12) United States Patent
Sobol

(10) Patent No.: US 10,665,219 B2
(45) Date of Patent: May 26, 2020

(54) APPARATUS AND METHOD FOR ACTIVE NOISE REDUCTION

(71) Applicant: ZEROSOUND SYSTEMS INC., Calgary (CA)

(72) Inventor: Raymond Sobol, Kelowna (CA)

(73) Assignee: ZEROSOUND SYSTEMS INC., Calgary (CA)

( * ) Notice: Subject to any disclaimer, the term of this patent is extended or adjusted under 35 U.S.C. 154(b) by 0 days.

(21) Appl. No.: 16/403,250

(22) Filed: May 3, 2019

(65) Prior Publication Data

US 2019/0287511 A1 Sep. 19, 2019

Related U.S. Application Data

(63) Continuation-in-part of application No. 16/262,899, filed on Jan. 30, 2019.

(Continued)

(51) Int. Cl.
*H04R 1/00* (2006.01)
*H04R 3/00* (2006.01)

(Continued)

(52) U.S. Cl.
CPC ..... *G10K 11/17823* (2018.01); *H04R 1/406* (2013.01); *H04R 3/005* (2013.01);

(Continued)

(58) Field of Classification Search
CPC ..... H04R 3/00; H04R 3/005; H04R 1/406; H04R 17/02; H04R 19/04; G10K 11/00;

(Continued)

(56) References Cited

U.S. PATENT DOCUMENTS 2,972,018 A * 2/1961 Hawley ..... H04R 3/002 381/71.6
3,136,867 A * 6/1964 Brettell ..... H04R 19/02 381/116

(Continued)

OTHER PUBLICATIONS

Colin H. Hansen, Does Active Noise Control have a Future, Research Gate, Manuscript No. 1226U, May 30, 2014, https://www.researchgate.net/publication/228780401.

(Continued)

*Primary Examiner* — Thang V Tran
(74) *Attorney, Agent, or Firm* — Bennett Jones LLP

(57) ABSTRACT

A method for active noise reduction includes sensing one or more characteristics of a sound wave; calculating an inverted sound wave based on the one or more characteristics; and emitting the inverted sound wave by flowing a current, selected according to the inverted sound wave, through a wire under tension that passes through a positive pole of a magnet and a negative pole of the magnet, thereby causing the wire to vibrate. An apparatus for active noise reduction includes a microphone configured to detect one or more characteristics of a sound wave detected in a predetermined vicinity of the microphone; a processor coupled to the microphone, configured to calculate an inverted sound wave based on the one or more characteristics; a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through the wire, the current selected by the processor to vibrate the wire and thereby emit the inverted sound wave.

6 Claims, 5 Drawing Sheets

Related U.S. Application Data

(60) Provisional application No. 62/624,612, filed on Jan. 31, 2018.

(51) Int. Cl.
*G10K 11/16* (2006.01)
*G10K 11/178* (2006.01)
*H04R 1/40* (2006.01)

(52) U.S. Cl.
CPC ..... *G10K 2210/3044* (2013.01); *G10K 2210/3046* (2013.01)

(58) Field of Classification Search
CPC ..... G10K 11/16; G10K 11/17823; G10K 2210/3044; G10K 2210/3046
See application file for complete search history.

(56) References Cited

U.S. PATENT DOCUMENTS 5,481,192 A * 1/1996 Mehlkopf ..... G01R 33/3852 324/318
5,937,070 A 8/1999 Todter et al.
6,125,189 A 9/2000 Yasuno et al.
6,192,133 B1 * 2/2001 Enamito ..... G10K 11/178 381/71.5
2001/0046303 A1 11/2001 Ohnishi et al.
2005/0231873 A1 10/2005 Nell
2009/0175484 A1 7/2009 Saint Vincent et al.
2009/0209842 A1 * 8/2009 Koevoets ..... G01R 33/3854 600/410
2011/0017545 A1 1/2011 Pompei
2013/0208923 A1 * 8/2013 Suvanto ..... H04R 3/005 381/122
2013/0251176 A1 9/2013 Goto et al.
2017/0256251 A1 9/2017 Krasnov et al.
2018/0199125 A1 * 7/2018 Gabai ..... H04R 1/08

OTHER PUBLICATIONS

International Search Report and Written Opinion of the International Search Authority dated Jan. 13, 2020 in respect of PCT/CA2019/050597.

* cited by examiner

APPARATUS AND METHOD FOR ACTIVE NOISE REDUCTION

BENEFIT OF EARLIER APPLICATIONS

This application is a continuation in part of U.S. Formal application Ser. No. 16/262,899, filed Jan. 30, 2019, which claims priority from U.S. provisional application 62/624,612, filed Jan. 31, 2018.

TECHNICAL FIELD

The present invention relates to active noise reduction and, in particular, active noise reduction over a plane.

BACKGROUND

Irritating sounds are oftentimes problematic in a wide range of settings including, for example, offices, homes, libraries, cars, outdoor roadways, construction sites, and industrial locations.

Broadly speaking, there are two types of noise reduction, which can be used alone or in combination. The first is passive noise reduction, which is generally achieved by insulating the ear from the external noise. Headphones may be insulated with material that prevents noise from reaching the ear. A room may use techniques known in the art as soundproofing to reduce an occupant's perception of noise coming from outside the room.

The second type of noise reduction is active noise reduction ("ANR"), being a method for reducing noise by emitting a second sound that cancels the unwanted noise. Known algorithms are able to analyze the waveform of a noise, and generate a signal that shifts the phase, or inverts the polarity of, the noise. When a first sound wave meets an inverted (also referred to as "antiphase") sound wave that is equal in both frequency and amplitude, the first and second sound waves effectively cancel each other out. Similarly, when a first sound wave meets a second sound wave with either more or less frequency and amplitude, the first wave is either reduced or amplified accordingly. Generally, active noise reduction as it is currently employed is effective in small areas such as the user's ears for headphones and for hearing aids, and ineffective at larger disperse areas. Using ANR in hearing aids is in addition to their use for amplifying frequencies for hearing impaired. Using ANR in headphones is in addition to their use for playing music.

SUMMARY OF INVENTION

In accordance with a broad aspect of the present invention, there is provided a method for active noise reduction, comprising sensing one or more characteristics of a sound wave; calculating an inverted sound wave based on the one or more characteristics; and emitting the inverted sound wave by flowing a current, selected according to the inverted sound wave, through a wire under tension that passes through a positive pole of a magnet and a negative pole of the magnet, thereby causing the wire to vibrate.

In accordance with another broad aspect of the present invention, there is provided an apparatus for active noise reduction, comprising: a microphone configured to detect one or more characteristics of a sound wave detected in a predetermined vicinity of the microphone; a processor coupled to the microphone, configured to calculate an inverted sound wave based on the one or more characteristics; a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through the wire, the current selected by the processor to vibrate the wire and thereby emit the inverted sound wave.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

(i)

(ii)

(iii)

(iv)

(v)

(vi)

(vii)

DETAILED DESCRIPTION OF EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Algorithms are able to process a waveform into an inverted sound waveform. For example, a noise-reducing headphone may include a microphone to detect a noise, a computer to process the noise and calculate the inverted waveform, and a speaker to emit a sound corresponding to the inverted waveform. The inverted noise waveform may be amplified and a transducer may create a sound wave proportional to the amplitude of the noise, creating destructive interference with the noise. Such destructive interference may make noise less perceptible to a listener. In this application, it shall be understood that the terms "noise" and "sound" may be used interchangeably.

Figure 8:
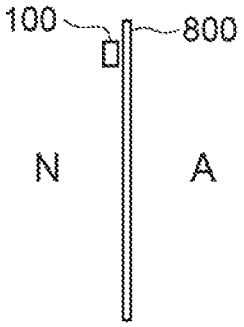
FIG. 8 is a top plan view of an active noise reduction apparatus.

Active noise reduction in headphones reduces noise only for a person wearing the headphones. In other words, ANR headphones are able to reduce noise at one point on a plane. It will be appreciated that it would be desirable to design a structure, such as a wall or fence, with ANR properties, such that noise can be actively reduced in an area A (FIG. 8) on an opposite side of the structure where noise N is occurring. This would allow multiple listeners to benefit from ANR in a room without having to wear headphones. The present invention addresses this deficiency in the prior art. The invention may allow for ANR over a plane, including a two-dimensional plane and a three-dimensional plane, i.e., over a flat surface or over a curved surface.

The algorithm may use machine learning by observing or collecting data of the noise the invention encounters in use. The algorithm may be capable of predicting noise and thereby improve the invention's accuracy, or ability to reduce noise accurately.

With reference to the Figs., in one embodiment, the invention includes a sound emitter module 400 with a conductor 410, such as a wire, tensioned on a frame 910 through which a sound passes and may be cancelled. The sound emitter 400 includes a magnet 300 to apply a magnetic force on the tensioned conductor 410. When an electrical current flows through the tensioned conductor 410 that is passing between the poles of the magnet 300, a periodic force perpendicular to the conductor 410 and a magnetic field are produced. This periodic force causes the conductor 410 to vibrate and thereby emit a sound. Altering one or both of i) the forces of the current, and ii) the magnetic field alters the sound wave that the vibrating tensioned conductor 410 emits.

The invention further includes a circuit 900, in which the wire 410 is connected. In one embodiment of the invention, an electrical circuit 900 further includes a transducer and/or a processor 500.

A transducer, such as microphone 100, detects a first sound wave and converts it into an electrical signal. Other single or multiple frequency measurement modules and wave amplitude measurement modules known in the art may be used, in addition to or instead of microphones.

A processor 500 may receive the electrical signal, invert the first sound wave's waveform, and calculate a current that may be sent through wire 410 by a power supply 800 connected to the circuit 900. The current may be calculated by the processor based on a number of factors, which may include the amplitude of the first sound wave, the frequency of the first sound wave, the speed of sound, and the material composition of the wire 410. The processor may be connected to a computer or computer components, including memory, operating systems, software, instructions, and algorithms for the processor to execute.

The power supply 800 may be a battery, a grid power source, a solar panel, example AC or DC. Many factors may affect the speed of sound, such as humidity and temperature. It is possible to measure the speed of sound at a given location by placing two microphones in close proximity to one another, for example 0.5 cm-3 cm apart, and comparing the sound waves detected over a period of time, for example 1 s, at both microphones. Sound wave speed between microphone 200 and microphone 100 may be calculated by dividing distance between the microphones by the elapsed time it takes for the sound wave to travel between the microphones 100 and 200. The speed of sound may be taken into account by the processor 500 when determining the current to flow through the wire 410. For example, the calculated speed of sound may be used to determine a delay period between the sound being picked up at the transducer and the sound wave being generated at the emitter module 400 so that the emitter module is driven to generate the appropriate inverted signal when the sound to be mitigated actually arrives at the module, as influenced by the calculated speed of sound. Another method for synchronizing received and emitted sound waves is to i) position a single microphone behind the emitter (that is, on the opposite side of the noise from the emitter), ii) use the microphone to detect the noise, iii) use the processor to determine an inverted signal, and iv) use the processor to correct the emitted signal, thereby improving performance. In such an embodiment, the processor may use, for example, machine learning techniques.

As noted, the emitter module 400 includes wire 410 and magnet 300. The wire 410 is under tension, and passes between the positive pole 310 and the negative pole 320 of the magnet 300. In particular, the magnet 300 has a positive pole 310 and a negative pole 320. The magnet 300 may be one or more magnets. For example, one magnet 300 may be oriented such that its positive pole is on one side of the wire, and its negative pole is on an opposite side of the wire. In another embodiment, two or more magnets 300 are used, such that the negative pole of a first magnet is on one side of the wire, and the positive pole of a second magnet is on another side of the wire. The wire is positioned in the space between the positive and the negative poles such that the magnetic force acts upon the wire. The wires may be installed in a tensioned condition on mounts or there may be tensioners for each wire. Various tensioning methods and devices may be employed to tension the wires, such as a turnbuckle, springs, permanent deflection, or a combination thereof.

The current flowing through the wire 410 causes the wire to vibrate and thereby emit a sound. The current is selected by the processor 500 such that the emitted sound will reduce the noticeability of, for example, substantially cancel out, the first sound wave within the vicinity of the wire. The microphone may be within 1 cm of the wire. The microphone may be on the side of the wire closer to the unwanted sound N.

The invention may include a frame 910 on which the emitter module 400 is installed. The frame may include frame components such as a plane with an open area 920 on it, or of rigid elongate members that are connected together to form a polygonal with the open area there between. The emitter module 400 is installed on the frame with wire 410 extending under tension across the open area 920. The one or more magnets 100, 200 may be in, on, or integral with the frame. The one or more magnets may be placed across the frame or parts of the frame such that the magnets are positioned 90 degrees to the wire 410. Each wire may have one or more magnets fixed thereto such that the wire may pass between the poles of the magnet. Wire 410 extends between ends of the frame, thereby extending across the opening through which sound may pass. The sound therefore passes through open area 920 and between and past wire 410. Wire 410, therefore, is directly in the path of sound waves and can act on them as they pass. The frame may be electrically non-conducting.

In one embodiment, there may be multiple wires 410 connected into circuit 900, and possibly to a single processor 500. The wires may be arranged in parallel, or in a grid pattern. Parallel here means the wires 410 may be arranged side by side substantially parallel to one another. Parallel does not necessarily refer to parallel circuitry. Each wire may have the same or a different current passed therethrough.

If arranged in a grid pattern, the wires 410 may, for example, be oriented at a 90 degree angle with respect to each other, so as to increase air turbulence between the wires in use. The wires may be electrically conductive in one direction, and connected by a non-electrically conductive material in a second direction. For example, conductive wires may run vertically, and non-conductive material may run horizontally (or vice versa), thereby connecting the vertical conductive wires to each other. This would allow the invention to, for example, act as a physical barrier preventing insects from passing therethrough, while allowing fluid communication from one side to the other. If the non-conductive material touches the conductive wires, the non-conductive material may be extendable such that their possible contact with the conductive wires does not quench sound-generating vibration thereof.

Figure 5:
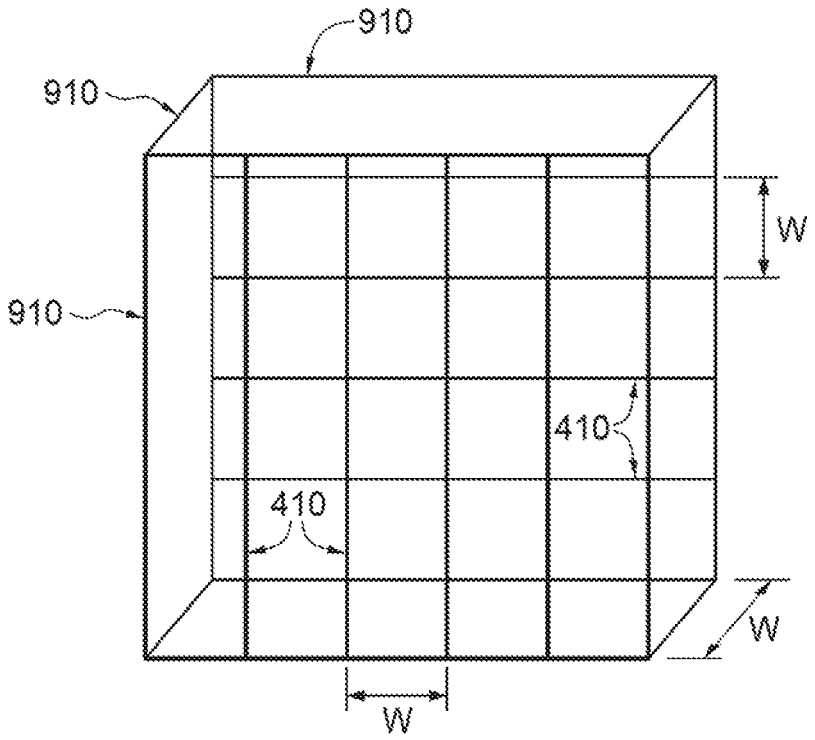
FIG. 5 is a perspective view of a configuration of wires running perpendicular to each other on two spaced apart planes.

As shown in FIG. 5, in another embodiment, there may be two sets of wires 410. A first set of wires 410 may run in a first direction, and a second set of wires 410 may run in a second direction. The second direction may be, for example, substantially 90 degrees from the first direction. For example, the first direction may be vertical, and the second direction may be horizontal. The first set of wires may run along a first plane, and the second set of wires may run along a second plane. The first plane and second plane may be substantially parallel to each other. The planes may be spaced apart such that no wire in the first set touches any wire in the second set when the wires vibrate.

Figure 6:
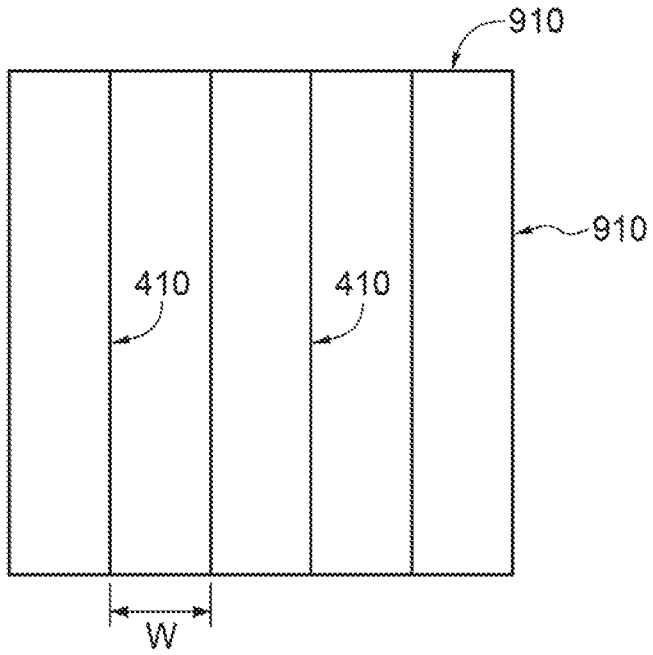
FIG. 6 is a plan view of a configuration of wires on a plane.

To be clear, where there is a plurality of wires 410, in one plane (FIG. 6), or in substantially parallel and spaced apart planes (FIG. 5), wires 410 may be spaced apart such that when vibrating they do not come into physical contact with each other. The distance between wires may be selected based on various factors, including the maximum width W of vibration. When adjacent wires are vibrating at their maximum amplitude (or, alternatively, maximum expected amplitude), the space between the wires will allow the wires to so vibrate freely. The minimum space between wires to allow this is equal to W. For example, wires may be positioned up to 1 cm apart. Wires should generally be at least distance W from anything, such as a surface in or on which the wires are installed, to allow the wires to vibrate freely. Microphones may be positioned near, for example, within 1 cm of one or more of the wires. In one embodiment, microphone 100 is positioned 1 cm away from the wire, and microphone 200 is placed between the wire and the first microphone, for example 0.5 cm away from the wire.

Figure 7:
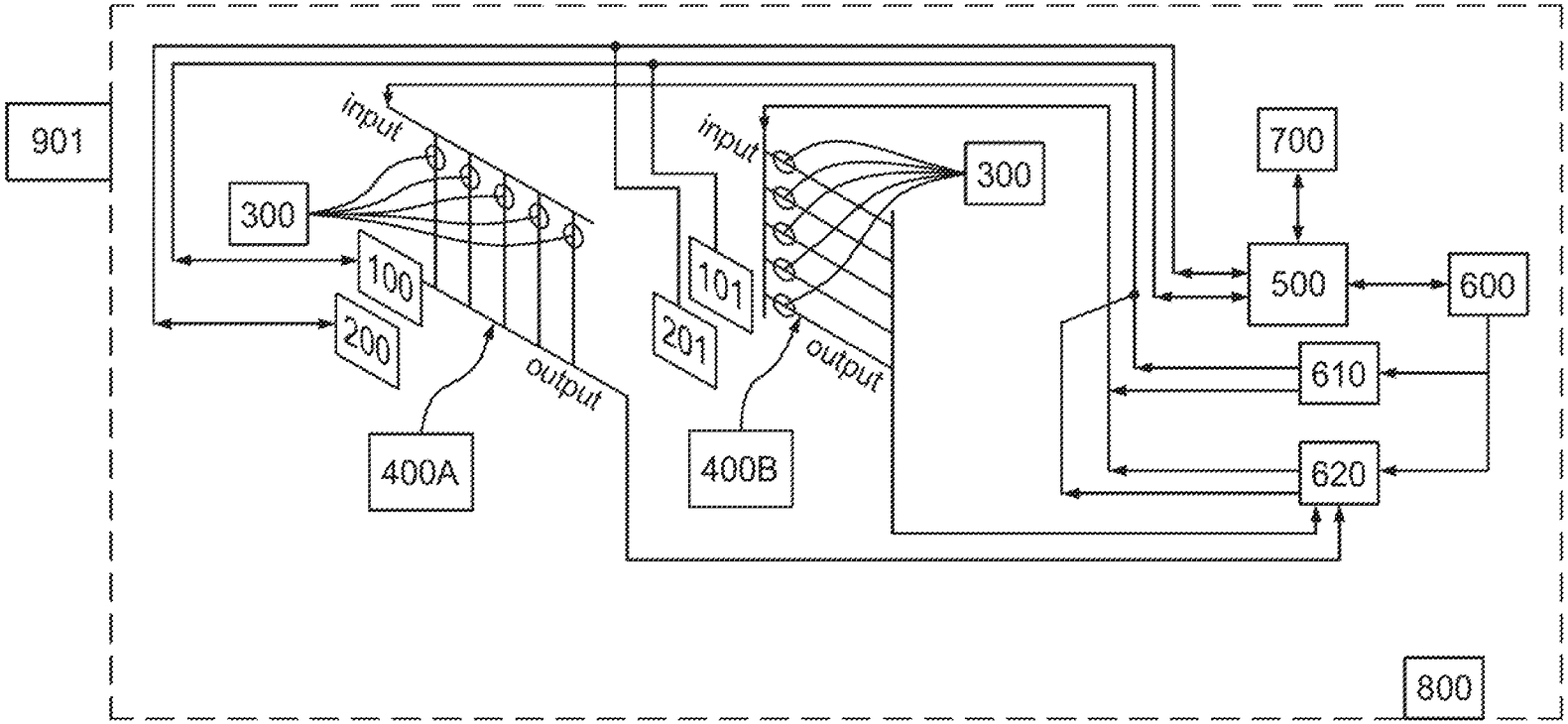
FIG. 7 is a schematic of an active noise reduction apparatus; and (viii)

FIG. 7 depicts an embodiment of the invention including electronic circuit 901 with two spaced apart conductor grid systems 400A, 400B each including a plurality of spaced apart, substantially parallelly oriented, tensioned conductor wires, each wire with an associated magnet 300 and each wire capable of being driven to emit a sound. While the grid systems could both be driven in response to the operation of one microphone, in this embodiment, each grid system 400A, 400B has at least one microphone for picking up sounds to be reduced. For example, in this embodiment microphones 100, 200 are for driving grid system 400A and microphones 101, 201, are for driving grid system 400B. This embodiment further includes a wifi module 700, processor 500 (the processor including an operating system, memory, software, algorithms, and instructions 600, frequency wave generator module 610, and wave amplifier module 620), and power supply 800.

The wires 410 may each be made of a conductive material, such as aluminum, copper, steel, or an alloy. The wire may be stranded or solid provided it can be tensioned. The wire may have a thickness of about 15-45 gauge or approximately 25-35 gauge. The wire need not be straight and may be a spring.

Further Embodiments

The emitter module 400 and frame 910 may together construct a structure, such as a wall, fence, screen, or tarp.

Figure 1:
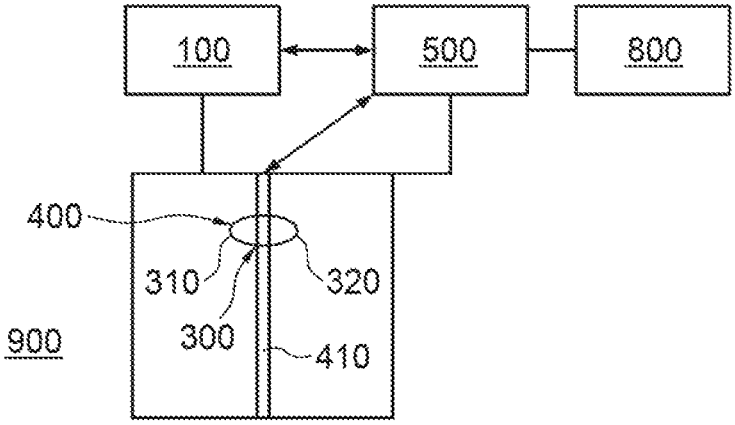
FIG. 1 is a schematic of an active noise reduction apparatus.
Figure 2:
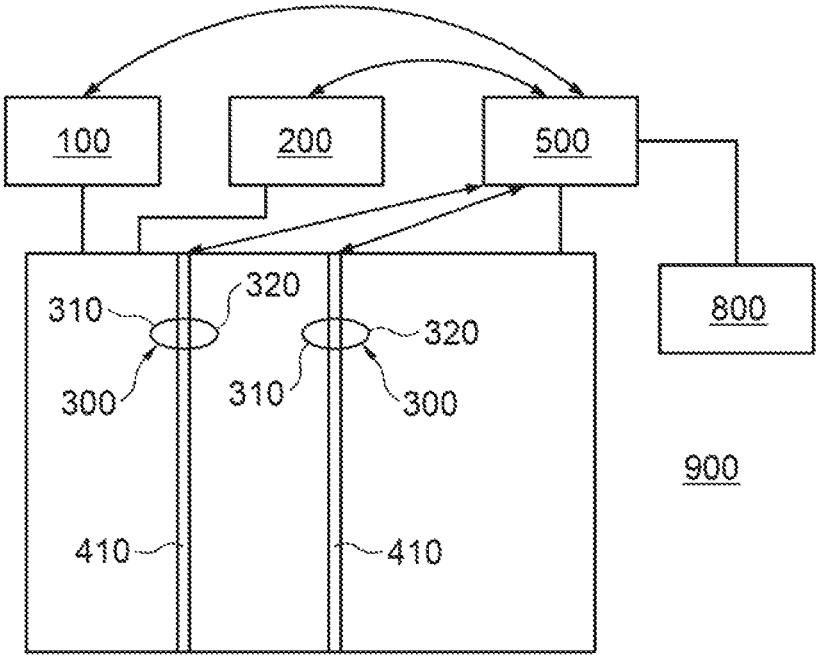
FIG. 2 is a schematic of an active noise reduction apparatus with two emitter modules and two microphones.
Figure 3:
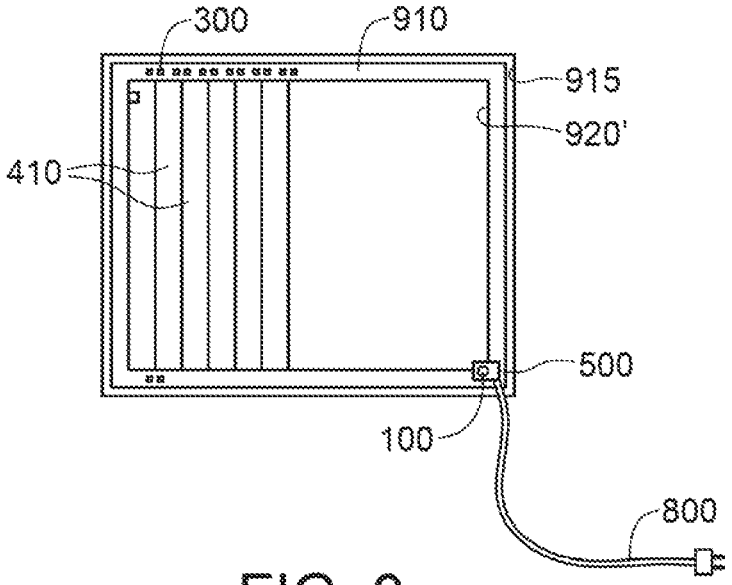
FIG. 3 is an elevation view of an active noise reduction apparatus installed in a screen.

With reference to FIG. 3, the structure, for example, can be a window screen where emitter 400 of one or more tensioned wires 410 for noise mitigation extend in one direction, extending from side to opposite side of the screen frame. The frame 910 can be made of elongate members such as frame extrusions of non-conductive material. Such a screen may allow fluid communication from one side of the screen to the other. Such a screen could be installed in a window opening 915 using, for example, frame extrusions with releasably connectable fasteners 920'. There may further be a transducer 100 coupled to, and protruding a small distance (for example 0.5 to 3 cm) from, an outer facing side thereof, a processor 500, and a power supply 800.

Figure 4:
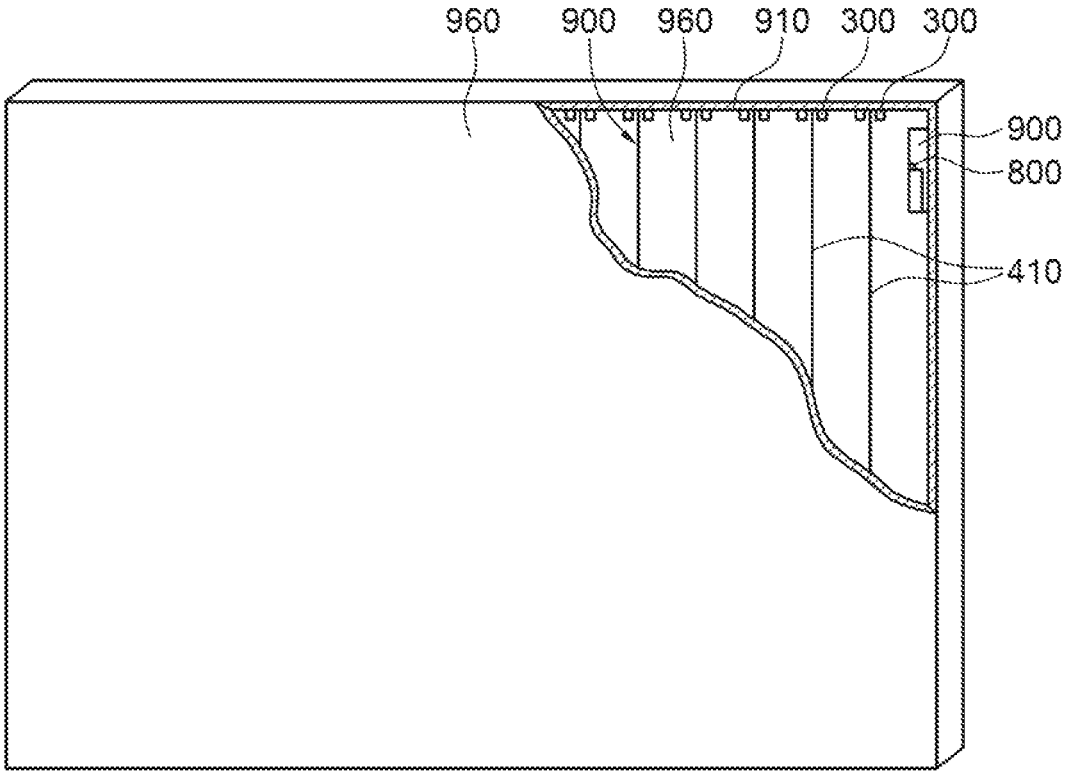
FIG. 4 is a partly cutaway view of an active noise reduction apparatus installed on sheet material.

With reference to FIG. 4, in another embodiment, the emitter module 400 and frame 910 could be installed on or inside a sheet of material or in a gap (as shown) between sheathing such as two sheets of material 960, such as drywall, wood, fabric, metal, concrete, or glass.

Regardless, in the embodiments of FIGS. 3 and 4, the wires 410 of the emitter modules 400 in each embodiment are tensioned and can be driven to emit an inverted waveform to cancel noises picked up by the transducers.

The wires 410 may be tensioned between two opposite sides of the frame 910 on which they are mounted, be it a screen frame, a support frame for sheathing or a frame formed of sheet material. In use, these embodiments could allow a person positioned at multiple points (for example, multiple points within area A on an opposite side of the structure from where noise N is occurring) near the structure to benefit from ANR. Such a structure, being in the path of the travelling sound wave, may also implement passive noise reduction techniques, such as soundproofing. In another embodiment, part or all of the circuit 900 may be built on or into a structure, or be behind a structure. The frame may be non-conductive.

There may be multiple microphones (for example, microphone 100 and microphone 200) at various locations on the structure. In addition to detecting the speed of sound, as discussed above, multiple microphones may serve the additional function of detecting differences in sound at different locations along a structure. This would be especially advantageous in a relatively large space, such as along a road, where sound may vary greatly along the structure. Each wire 410 may have a different current passed therethrough, such that each wire more accurately negates the noise in its vicinity or range. One or more of the plurality of microphones may be monitored continuously, or on a schedule.

Multiple microphones may serve various purposes, including i) synchronization of inbound and emitted (cancelled) soundwaves, and ii) synchronization of cancelled sound waves over large areas. With regard to the former, sound waves in air may be affected by several factors, including wind, air density, temperature, pressure and humidity. When it is desirous to cancel out inbound sound waves, attention must be given to controlling when and where the desired cancellation is to occur. If the signals are not in anti-phase to each other, the cancellation will be less effective or may cause amplification of the undesired sound, thereby increasing the sound. The emitter design resolves the location. By employing two microphones that are physically located at a precise distance from each other and the emitter, the speed of sound can be determined by measuring the sound level and time at the first microphone, then the sound level and time at the second level. Using this method the speed of sound is calculated as speed equals distance divided by time, since existing air conditions are being measured, this formula accounts for air density, temperature, pressure and humidity in real time. Wind also affects speed of sound and its direction my cause a slower or faster speed. The microphones must be in close proximity (within 1 cm) to the emitter to mitigate the changes of wind affects. Closer positioned microphones, both to each other and to the emitter will have higher accuracy in measuring the speed of sound, which when considered by the processor to cancel inbound sound waves at the emitter, thereby improving precision and performance. With regard to the latter, where noise cancellation is desired at larger areas, a single set of microphones may be suitable to measure incoming sound waves, and provide the emitter with effective emitted (cancelling) signals. If needed, sound level measurements can be made across the area to determine if a single set of microphones or a number of sets of microphones are required to best cancel inbound should waves. The processor may be capable of calculating (using the output of the microphone or microphones) changing conditions such as a loud truck passing by a traffic noise barrier. In this example the emitter may be comprised of numerous smaller emitter areas, each of an area equipped with at least one set of microphones, and each area may be independently controlled for providing an individual emitter with effective cancelling signals. An unlimited number of smaller emitters may thus be assembled to perform noise cancellation for larger areas.

Microphones 100, 200 may be tuned to detect sound in a predetermined vicinity of the given microphone, for example within 1 m in any direction, or within 1 m in a given direction or directions. For example, if noise is expected to come from a particular direction relative to the microphone, the microphone may be tuned to pick up sound in that direction. Conversely, the microphones can be tuned to ignore certain directions in order to avoid cancelling sounds originating from such directions. For example, it may be useful to avoid cancelling sounds coming from a smoke detector located at a known place on the ceiling of a room in which the invention is installed.

In embodiments with multiple microphones 100, 200 or multiple emitters 400, the processor 500 may execute an algorithm for synchronizing the components.

The processor 500 may be connected to a network, such as a wired or WiFi network, such that the processor can communicate with other devices. This could also enable remote control of the apparatus, for example for it to be powered on and off remotely. Thus circuit 900 can include wired or wireless configurations.

In one embodiment, rather than using one electrical circuit, the various components can communicate wirelessly, for example using WiFi or Bluetooth. That is, the microphone 100 or 200, processor 500, and emitter 400 of the same embodiment may each have their own circuits and communicate wirelessly.

EXAMPLE

An embodiment of the present invention was tested in a lab at the Southern Alberta Institute of Technology, implementing the methods and materials described in this paragraph. A tensioned wire of approximately 20 gauge was connected between two fixed locations approximately 0.6 metres apart. Two bar magnets were installed at one end of the wire's fixed location such that the wire passed between the poles of the magnet, thereby inducing an electromagnetic force when current was applied. An audio speaker was connected to a signal generator and amplifier, and located to project sound into a box. The box was configured with an approximately 10 cm sound hole (similar to a guitar sound hole), located directly under and within 0.5 cm of the wire. A microphone was installed through the box's side wall to measure sound inside the box. This particular test set up was used to control for ambient sound. It was expected that when the speaker was tuned to emit a sound wave, and the wire was tuned to emit an anti-phase sound wave of the speaker's sound wave, that the sounds emitted by the speaker and the wire would cancel each other out. First, a fixed signal of 146.8 Hz was driven to the speaker, measured in the box and then projected through the sound hole. Second, a fixed anti-phase signal of 146.8 Hz was driven to the wire, resulting is the wire vibrating at the same frequency. Third, the fixed signal of 146.8 Hz and the fixed anti-phase signal of 146.8 Hz were both emitted. Finally, the resulting, combined sound was measured. A sound reduction of greater than 50% was measured.

The present invention may have numerous applications, for example:

(i) Traffic noise barrier, as discussed above;

(ii) Industrial noise protection, such as at a wellbore fracturing (fracking) site, in which the invention is installed in or as a large fence, such as a series of sections of, for example, approximately 20 ft (6.1 m) high by approximately 12 ft (3.7 m) wide, configured to surround or encircle fracking equipment;

(iii) To reduce noise produced by equipment, for example by encircling equipment, including compressors, pumps, engines, air conditioners, and other machinery;

(iv) Indoor noise protection, for example in an office, hospital, or home, in which the invention is used on or in walls or partitions, and may reduce sound or create a quiet room or area;

(v) Automobile noise reduction, for example by installing the invention in the walls or floor of an automobile;

(vi) Aircraft noise reduction, for example, by installing the invention in the walls, ceiling, and flooring of an aircraft; and (vii) Entertainment areas, such as in the walls or tarps of a music venue or tent, or at restaurants, bars and large indoor meeting rooms.

Reference Signs List

| # | Component |
|---|---|
| 100, 200, 101, 201 | Transducer (e.g., Microphone) |
| 300 | Magnet |
| 310 | Positive Pole |
| 320 | Negative Pole |
| 400 | Emitter Module |
| 400A, 400B | Conductor Grid System |
| 410 | Conductor |
| 500 | Processor |
| 600 | Operating System, Memory, Software, Algorithms, Instructions |
| 610 | Frequency Wave Generator Module |
| 620 | Wave Amplifier Module |

-continued

| Reference Signs List | |
|---|---|
| # | Component |
| 700 | Wifi Module |
| 800 | Power Supply |
| 900 | Circuit |
| 901 | Circuit |
| 910 | Frame |
| 920 | Open Area |
| 920' | Releasably Connectable Fasteners |
| A | Area |
| N | Noise |

Clauses

Clause 1. A method for active noise reduction, comprising sensing one or more characteristics of a sound wave; calculating an inverted sound wave based on the one or more characteristics; and emitting the inverted sound wave by flowing a current, selected according to the inverted sound wave, through a wire under tension that passes through a positive pole of a magnet and a negative pole of the magnet, thereby causing the wire to vibrate.

Clause 2. The method of any one or more of clauses 1-14, wherein sensing includes sensing at a plurality of locations.

Clause 3. The method of any one or more of clauses 1-14, wherein the plurality of locations includes a first location and a second location, and calculating further includes computing a speed of sound between the first location and the second location based on a distance between the first location and the second location, and the one or more characteristics detected over a period of time at each of the first location and the second location.

Clause 4. The method of any one or more of clauses 1-14, wherein the one or more characteristics includes one or more of a frequency and an amplitude.

Clause 5. An apparatus for active noise reduction, comprising: a microphone configured to detect one or more characteristics of a sound wave detected in a predetermined vicinity of the microphone; a processor coupled to the microphone, configured to calculate an inverted sound wave based on the one or more characteristics; a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through the wire, the current selected by the processor to vibrate the wire and thereby emit the inverted sound wave.

Clause 6. The apparatus of any one or more of clauses 1-14, wherein the microphone is positioned within 1 cm of at least one of the one or more wires.

Clause 7. The apparatus of any one or more of clauses 1-14, wherein the at least one emitter module includes a first emitter module and a second emitter module, and wherein the wire of the first emitter module is substantially parallel to and positioned within 1 cm of the wire of the second emitter module.

Clause 8. The apparatus of any one or more of clauses 1-14, wherein the at least one emitter module includes a first emitter module and a second emitter module, and wherein the wire of the first emitter module is substantially perpendicular to the wire of the second emitter module.

Clause 9. The apparatus of any one or more of clauses 1-14, further comprising a second microphone spaced a distance from the microphone; and the processor being further configured to calculate a speed of sound between the microphone and the second microphone based on the distance, and by comparing the sound waves detected over a period of time by the microphone and the second microphone; and the one or more characteristics includes the speed of sound.

Clause 10. The apparatus of any one or more of clauses 1-14, wherein the one or more characteristics includes one or more of a frequency and an amplitude.

Clause 11. The apparatus of any one or more of clauses 1-14, further comprising being installed in association with a structure.

Clause 12. The apparatus of any one or more of clauses 1-14, wherein the structure is one or more of a wall, a tarp, a screen and a fence.

Clause 13. The apparatus of any one or more of clauses 1-14, further comprising being installed on a frame.

Clause 14. The apparatus of any one or more of clauses 1-14, wherein the frame is for a window installation.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. An apparatus for active noise reduction, comprising:

a microphone configured to detect one or more characteristics of a sound wave detected in a predetermined vicinity of the microphone;

a processor coupled to the microphone, configured to calculate an inverted sound wave based on the one or more characteristics;

a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through the wire, the current selected by the processor to vibrate the wire and thereby emit the inverted sound wave.

2. The apparatus of claim 1, wherein the microphone is positioned within 1 cm of at least one of the one or more wires.

3. The apparatus of claim 1, wherein the at least one emitter module includes a first emitter module and a second emitter module, and wherein the wire of the first emitter module is substantially parallel to and positioned within 1 cm of the wire of the second emitter module.

4. The apparatus of claim 1, wherein the at least one emitter module includes a first emitter module and a second emitter module, and wherein the wire of the first emitter module is substantially perpendicular to the wire of the second emitter module.

5. The apparatus of claim 1, further comprising a second microphone spaced a distance from the microphone; and the processor being further configured to calculate a speed of sound between the microphone and the second microphone based on the distance, and by comparing the sound waves detected over a period of time by the microphone and the second microphone; and the one or more characteristics includes the speed of sound.

6. The apparatus of claim 1, wherein the one or more characteristics includes one or more of a frequency and an amplitude.

* * * * *